US009125244B2

(12) United States Patent
Oagley et al.

(10) Patent No.: US 9,125,244 B2
(45) Date of Patent: Sep. 1, 2015

(54) INDUCTION COOKTOP COOLING KIT

(75) Inventors: Howard James Oagley, Louisville, KY (US); Mark Davis Johnson, Louisville, KY (US); Daniel Stephen Frazer, West Chester, OH (US); David Joseph Najewicz, Prospect, KY (US)

(73) Assignee: General Electric Company, Schenectady, NY (US)

( * ) Notice: Subject to any disclaimer, the term of this patent is extended or adjusted under 35 U.S.C. 154(b) by 1032 days.

(21) Appl. No.: 13/151,828

(22) Filed: Jun. 2, 2011

(65) Prior Publication Data

US 2012/0305544 A1 Dec. 6, 2012

(51) Int. Cl.
*H05B 6/12* (2006.01)

(52) U.S. Cl.
CPC ..... *H05B 6/1263* (2013.01); *H05B 6/1209* (2013.01)

(58) Field of Classification Search
USPC ..... 219/449.1, 452.11, 452.12, 622, 623, 219/620, 677; 126/1 R, 21 A, 21 R
See application file for complete search history.

(56) References Cited

U.S. PATENT DOCUMENTS

| | | | | |
|---|---|---|---|---|
| 3,402,281 | A | 9/1968 | Vonderhaar | |
| 4,431,892 | A | 2/1984 | White | |
| 2009/0223944 | A1 * | 9/2009 | Sukhman et al. | 219/121.84 |
| 2010/0163549 | A1 | 7/2010 | Gagas et al. | |
| 2010/0219179 | A1 * | 9/2010 | Lin | 219/623 |

FOREIGN PATENT DOCUMENTS

| | | | |
|---|---|---|---|
| EP | 0675672 | A1 | 10/1994 |
| EP | 1601236 | A2 | 11/2005 |

OTHER PUBLICATIONS

Search Report and Written Opinion for corresponding European Application No. 12170303, dated Dec. 18, 2012.

* cited by examiner

*Primary Examiner* — Brian Jennison
(74) *Attorney, Agent, or Firm* — Dority & Manning, P.A.

(57) ABSTRACT

An induction cooktop appliance includes a housing having an air intake opening and an air exhaust opening, the air intake opening and the air exhaust opening defining an air cooling circulation path, an induction cooktop disposed on top of the housing, electronics for the induction cooktop disposed within the housing, and a vent tube having a first end and a second end, the vent tube being disposed in the cooling air circulation path and configured to segregate air entering the air intake opening from air exiting the air exhaust opening.

17 Claims, 5 Drawing Sheets

INDUCTION COOKTOP COOLING KIT

BACKGROUND OF THE INVENTION

The present disclosure generally relates to induction cooktop systems, and more particularly to an improved cooling system for an induction cooktop.

Induction cooktops heat conductive cooking utensils by magnetic induction. An induction cooktop applies high frequency (e.g. 20-100 Khz) current to an induction coil located underneath the cooking surface to generate a strong high frequency magnetic field above the induction coil. When a ferromagnetic conductive object or vessel, such as a pan, is placed over the induction coil, the magnetic field coupling from the induction coil generates eddy currents within the vessel. The eddy currents within the vessel cause the vessel to heat.

A cooktop using induction heating for cooking normally includes a housing or cabinet that supports a cooking surface. Typically, the cooking surface is made of glass or other non-magnetic and non-conductive material. One or more induction coils or elements are located underneath the cooking surface. The housing will generally also include the electronics and other electrical components needed to supply the high frequency electrical power to the induction coils. The electronic circuits are also typically mounted underneath the cooking surface of the cooktop, generally below the induction coils and enclosed in the housing. The electronic circuitry creates the high frequency electric current applied to the induction coils. The generation of the high frequency current supply to the coils results in thermal losses that must be dissipated. With the increasing heat dissipation from induction devices, as well as the need to reduce the depth of the housing, thermal management is an important element of induction cooktop product design. The heat that is generated needs to be dissipated in order to avoid excessive temperature buildup and damage to the electronics. Both the performance reliability and life expectancy of the induction cooktop can be negatively affected by higher component temperatures. Effective control of the operating temperature of induction cooktop components can result in increased life and more reliable performance.

One method of dissipating the heat generated by an induction cooktop is a fan that circulates air through the cabinet to cool the electronic components. These types of systems tend to draw air in from the bottom of the cabinet near the rear, and exhaust the air through openings in the front of the cabinet. In some cases, particularly where the induction cooktop is part of a system that includes other components or systems, such as a warming drawer or oven mounted below the cooktop, the cooktop exhaust airflow can recirculate to the air inlet, thus the hot exhaust air is drawn directly back into the air intake by the cooktop cooling fan, resulting in increased inlet air temperature to the induction cooktop, resulting in less cooling capacity to the electronics. In such a situation, the electronics are not cooled. The elevated temperature levels can lead to component failure or reduced component life and cooking performance.

Accordingly, it would be desirable to provide a system that addresses at least some of the problems identified above.

BRIEF DESCRIPTION OF THE INVENTION

As described herein, the exemplary embodiments overcome one or more of the above or other disadvantages known in the art.

One aspect of the exemplary embodiments relates to an induction cooktop appliance. In one embodiment, the appliance includes a housing having an air intake opening and an air exhaust opening, the air intake opening and the air exhaust opening defining an air cooling circulation path, an induction cooktop disposed on top of the housing, electronics for the induction cooktop disposed within the housing, and a vent tube having a first end and a second end, the vent tube being disposed in the cooling air circulation path and configured to segregate air entering the air intake opening from air exiting the air exhaust opening.

Another aspect of the disclosed embodiments relates to an appliance. In one embodiment the appliance includes a cabinet defined by a front wall, top wall, back wall, bottom wall and side walls, an induction cooktop disposed in an opening in the top wall of the cabinet, a housing for the induction cooktop, electronics for the induction cooktop disposed within the housing, the housing including an air intake opening and an air exhaust opening defining an air cooling circulation path, a built-in appliance disposed in an opening in the front wall of the cabinet and below the induction cooktop, a first interior cabinet air area defined between the built-in appliance and the induction cooktop, a second interior cabinet air area defined between the built-in appliance and the bottom wall of the cabinet, and a vent tube having one end coupled to the air intake opening in the housing and a second end disposed in the second interior cabinet air area.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE INVENTION

Figure 1:
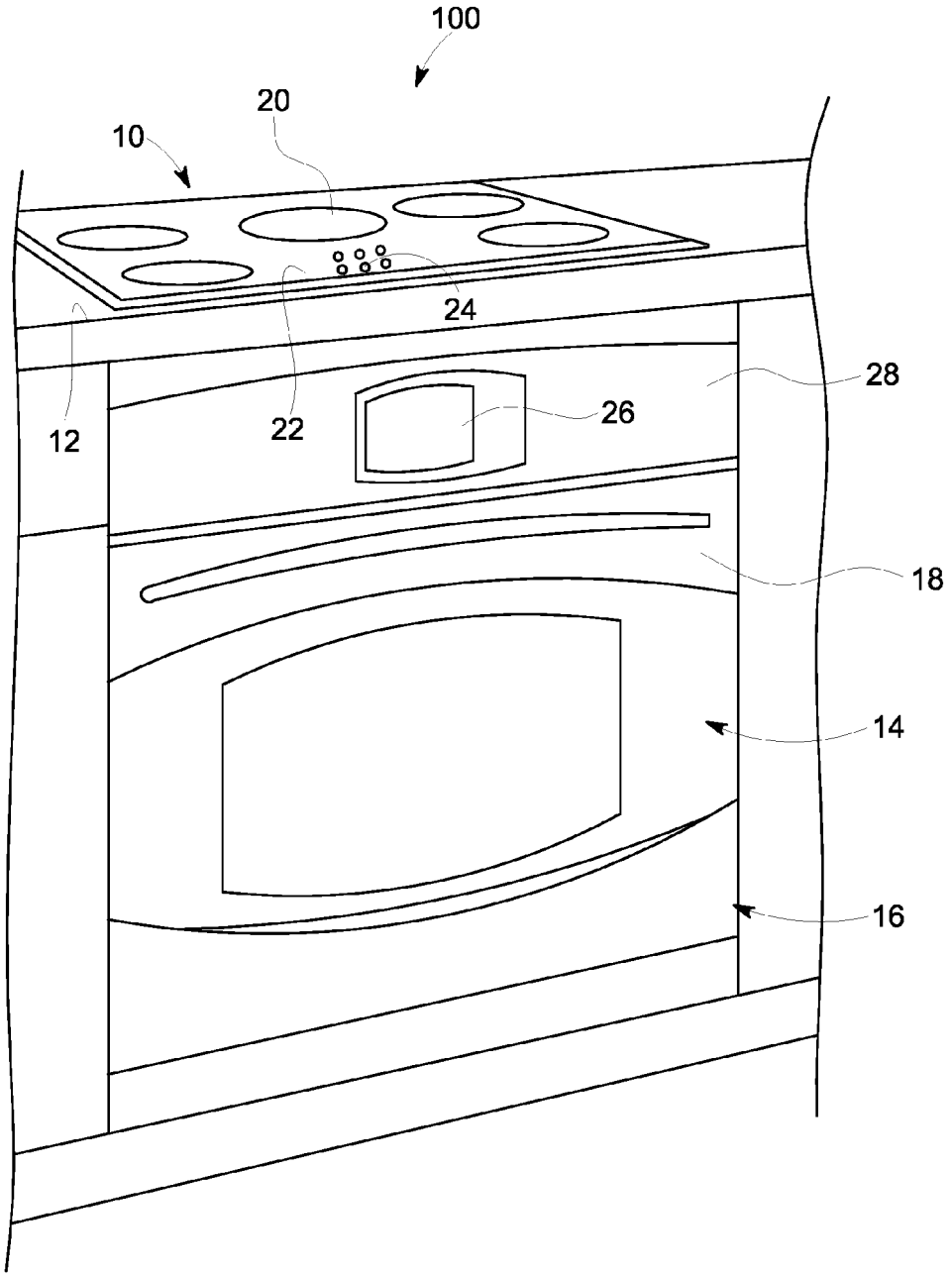
FIG. 1 is a perspective view of an appliance incorporating aspects of the disclosed embodiments.

Referring to FIG. 1, an exemplary cooking appliance, such as an induction cooktop system incorporating aspects of the disclosed embodiments, is generally designated by reference numeral 100. As is shown in FIG. 1, the induction cooktop system 100 generally comprises an induction cooktop 10 mounted in a standard kitchen countertop 12 over a built-in appliance 14, such as an oven, for example. For the purposes of the description herein, the built-in appliance 14 shall be referred to as an oven 14, such as a wall oven. In alternate embodiments, the built-in appliance 14 can be any appliance or other object that can be mounted underneath an induction cooktop, such as for example, a storage drawer, a warming drawer or a microwave oven. The aspects of the disclosed embodiments are directed to improving the dissipation of heat from the electronic components of the induction cooktop. Although the aspects of the disclosed embodiments will generally be described herein with respect to an induction cooktop mounted in a countertop 12 over an oven 14, in alternate embodiments, the aspects of the present disclosure can be applied to any induction cooktop system.

The induction cooktop 10 shown in FIG. 1 is generally supported by the countertop 12. In one embodiment, the oven 14 is positioned below the cooktop 10 and can include a front-opening access door 18. The induction cooktop 10 and oven 14 are generally defined within a cabinet 16. Although a countertop 12 is shown in the example of FIG. 1, in alternate embodiments, the cabinet 16 can include a top member other than a countertop, which is configured to support the induction cooktop 10. An example of such a configuration could be a free standing induction cooktop appliance, similar to a free-standing range.

The induction cooktop 10 shown in FIG. 1 includes induction coil assemblies or elements 20 that are positioned in a spaced apart relationship. The induction cooktop 10 can include any number of induction coil assemblies 20 arranged in any suitable configuration. Each induction coil assembly or element 20 is covered by, or positioned underneath, a cooking surface 22. The induction cookwear is generally placed on the cooking surface 22 over an induction coil assembly 20. In one embodiment, the heating surface 22 is a glass surface.

The induction cooktop 10 can also include one or more control devices 24, such as electronic switches, that are manipulated by the user to adjust the heating setting of a corresponding induction heating coil assembly 20. Although the control devices 24 are shown in FIG. 1 as being electronic switches accessible through the cooking surface 22, in alternate embodiments, the control devices 24 can comprise any suitable control mechanism, such as for example, a slidable switch or knob control.

In one embodiment, the appliance 100 can also include a control panel and/or display 26 mounted on or in a control panel surface or cabinet member 28. In one embodiment, one or more of the control devices 24 can be located on the control panel 26. A controller (not shown) can be coupled to the control panel 26. In one embodiment, the control panel 26 can include switches or controls (not shown) that can be used to control one or more functions of the appliance 100, such as the oven 14 or induction heating coil assemblies 20.

Figure 2:
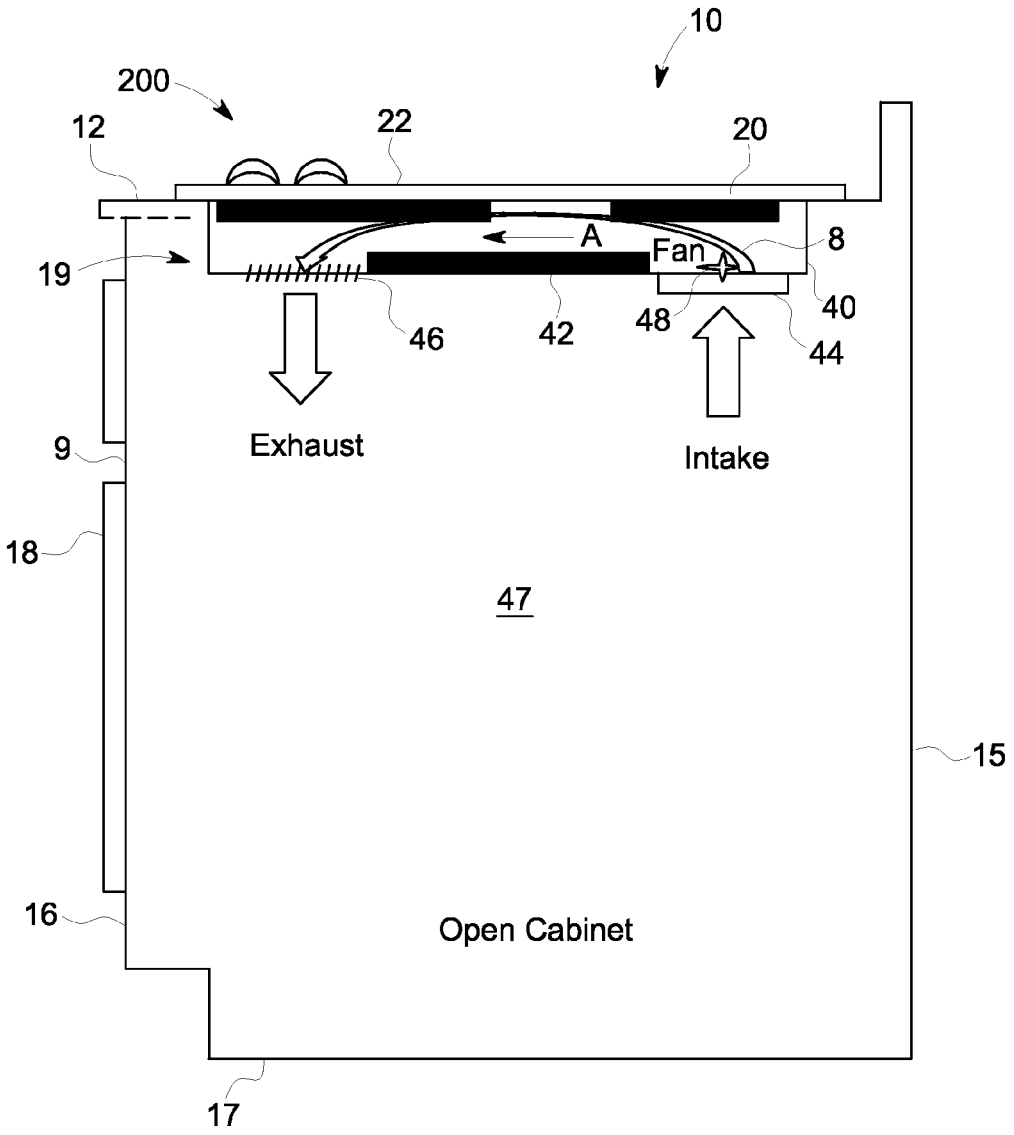
FIG. 2 PRIOR ART
FIG. 2 is a side cross-sectional view of an appliance of the prior art.

FIG. 2 illustrates an open cabinet style induction cooktop appliance 200 of the prior art. As shown in FIG. 2, the cooktop 10 is supported from and mounted in an opening 19 in the countertop 12 and includes a housing 40 that extends below cooktop 10 into an area defined by the cabinet 16. The cabinet 16 includes a front wall 9, top wall 11, opposing side walls 13, back wall 15, and bottom wall 17.

The housing 40 is generally supported by the countertop 12 or the cabinet 16 within the opening 19. As is shown in FIG. 2, the electronics 42 for the induction cooktop 10 are disposed within the housing 40 below the induction heating coil assemblies 20. The housing 40 includes an air intake opening 44 and an air exhaust opening 46 for allowing air to pass through the housing 40 in a direction generally indicated by arrow A, generally referred to as the air cooling circulation pathway 8. The air entering from intake 44 generally passes over and around the electronics 42 and out the exhaust vent or opening 46. A fan 48 is positioned near the intake 44 to help draw air into the housing 40.

In this example, the air cooling circulation pathway 8 that is used to cool the electronic components 42 within the cabinet 40 draws in air from the cabinet space 47 through intake 44. The air generally moves through the housing 40 in the direction indicated by arrow A, and out the exhaust vent 46. The air being exhausted out the vent 46 is generally at a higher temperature due to the heat dissipation from the electronics 42, and other heat rendering or retaining components thermally coupled with the housing 40. However, since the intake 44 draws air from the cabinet space 47, the temperature of the intake air can be at or near the temperature of the exhaust air. As the temperature of the intake air rises, the cooling effect of the air cooling pathway 8 is reduced or minimized. This leads to increased temperatures within the housing 40, which can produce undesirable effects, such as reduced electronic component reliability and life.

Figure 3:
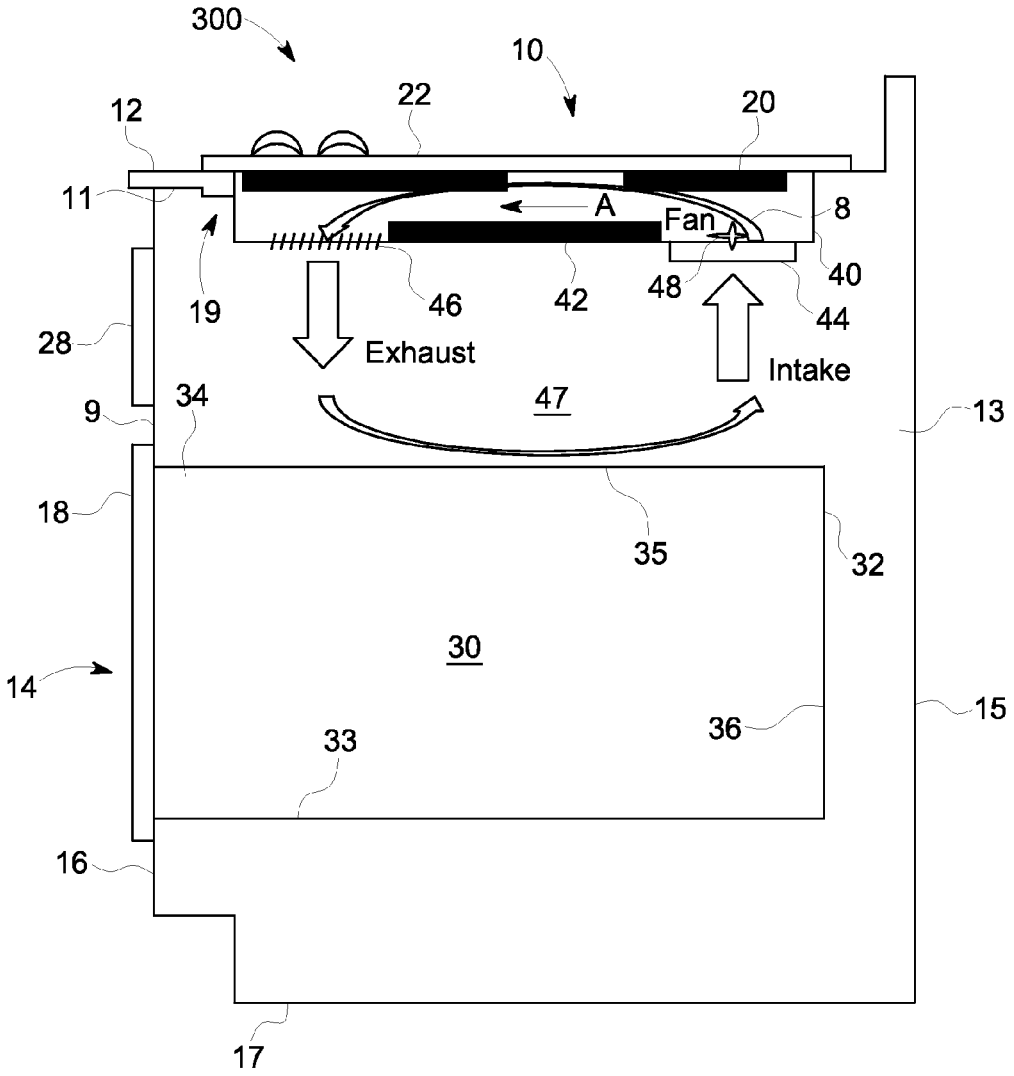
FIG. 3 PRIOR ART
FIG. 3 is a side cross-sectional view of an appliance of the prior art.

FIG. 3 is a side cross-sectional view of another induction heating appliance 300, similar to the appliance 200 shown in FIG. 2. Unlike the open cabinet configuration shown in FIG. 2, in this example, the appliance 300 includes a built-in appliance 14, which in this example is an oven. As shown in FIG. 3, both the oven 14 and the cooktop 10 are mounted under the countertop 12 in an area defined by the cabinet 16.

The oven 14 shown in FIG. 3 includes an oven cavity 30 defined within the cabinet 16. The oven cavity 30 is formed from a boxlike oven liner 32 in combination with the front-opening access door 18. The oven liner 32 includes a bottom wall 33, opposing vertical sidewalls 34, a top wall 35 and a rear wall 36.

As is shown in FIG. 3, the problem with this configuration is that the intake 44 draws air from the cabinet space 47, also referred to as "interior cabinet air", which is the same space into which the higher temperature air from the housing 40 is exhausted. In this example, the size of the cabinet space 47 is less than that shown in FIG. 2, due to the presence of the oven cavity 30. Thus, the temperature of the air being drawn in by the intake 44 will be at or near the temperature of the air being vented through exhaust 46. Since the intake 44 draws air from the cabinet space 47, as the higher temperature air from the housing 40 is delivered into the cabinet space 47, this higher temperature air is drawn by the intake 44 and delivered into the cabinet 40. The cooling effect of the higher temperature air within the housing 40 is minimal, which leads to increasing temperatures within the housing 40. The increasing temperatures can produce undesirable effects.

Figure 4:
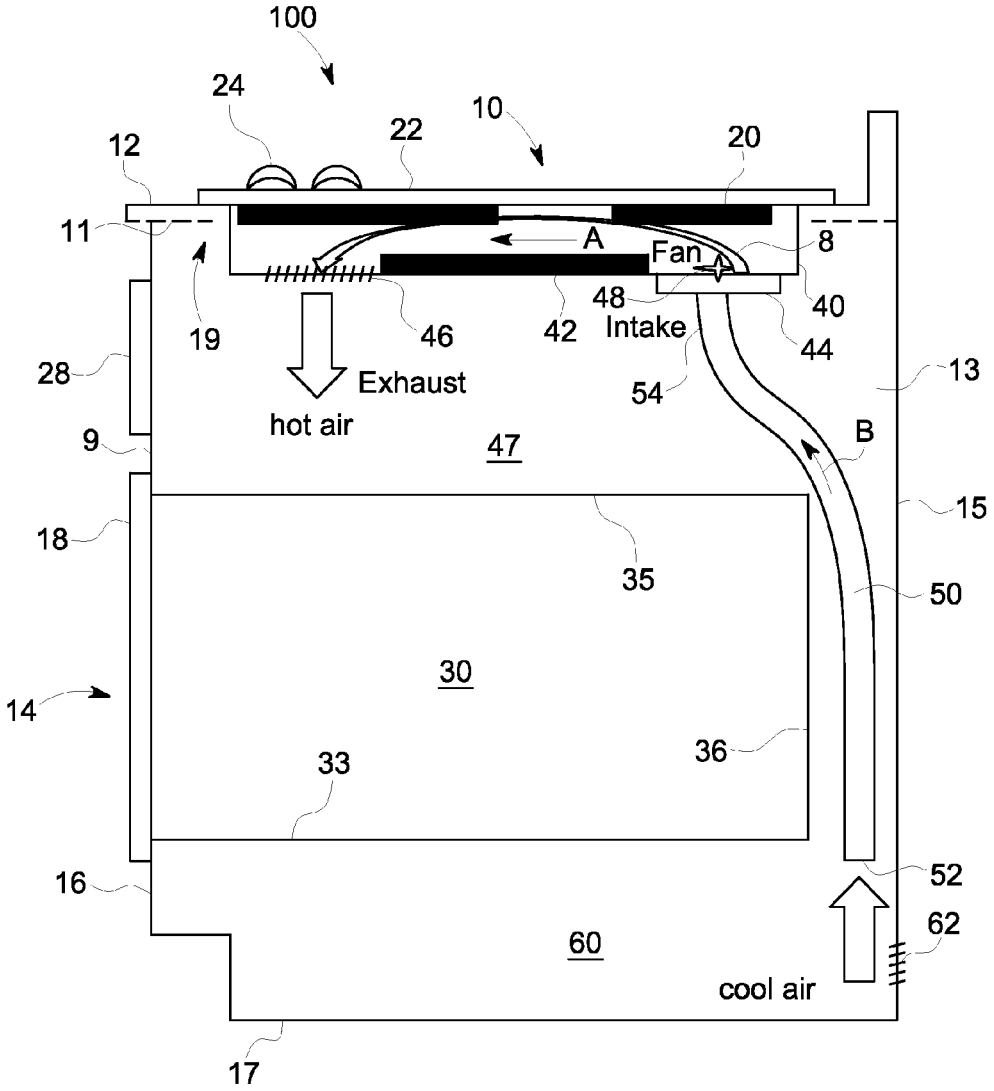
FIG. 4 is a side cross-sectional view of one embodiment of the appliance shown in FIG. 1.

The aspects of the disclosed embodiments are directed to improving the cooling or heat dissipation of the electronics 42 within the housing 40 of the induction cooktop 10. Referring to FIG. 4, in one embodiment, in order to prevent the higher temperature "interior cabinet air" from being drawn by the intake 44 into the housing 40, a vent tube 50 is positioned within the cabinet 16. A first end 52 of the vent tube 50 is disposed in a bottom region 60 of the cabinet 16. The bottom region 60 of the cabinet 16 is generally configured to have a supply of air that is lower in temperature than a temperature of the interior cabinet air found in area 47. The second end 54 of the vent tube 50 is coupled to the intake opening or vent 44. The intake 44 will draw air from the bottom region 60 through the vent tube 50 and into the housing 40.

In the embodiment of FIG. 4, the back wall 15, bottom wall 17 and/or the front wall 9, includes vent opening 62 that will allow outside or external air to be drawn into the bottom region 60 of the cabinet 16. The first end 52 of the vent tube 50 is positioned in the bottom region 60 proximate to vent opening 62. Alternate embodiments may include more than on vent opening and such opening or openings may be formed in others of the cabinet walls 9, 13, 15, 17 to draw external air directly from outside the cabinet. The first end 52 of vent tube 50 may be coupled to one or more such vent openings.

The air drawn into the first opening 52 travels up the vent tube 50 in the direction generally indicated by arrow B and out the second end 54 into the intake opening 44. In the embodiment of FIG. 4, the fan 48 facilitates the drawing or intake of air through the vent tube 50 and opening 44. The air passes through the housing 40, over and around the electronics 42, induction heating elements 20, and heating surface 22, drawing heat away from the electronics 42 or other areas of heat generation or retention in a manner that is generally known. The higher temperature air is exhausted into the area 47 of cabinet 16 through exhaust opening 46. Since the vent tube 50 is coupled to the intake opening 44 by the second end 54, the higher temperature air in the area 47 is not drawn back into the opening 44 and does not recirculate in the housing 40. Rather, lower temperature air is drawn from the bottom region 60 of the cabinet 16, through the vent tube 50 and intake opening 44, and into the housing 40. Thus, the cooling effect within the housing 40 is enhanced.

The vent tube 50 generally comprises a rigid or flexible tube, piping or hose that is heat resistant, or is capable of withstanding temperatures that are typically realized within a cabinet for an induction cooking appliance. In one embodiment, the vent tube 50 comprises a flexible metal conduit. In alternate embodiments, the vent tube 50 can comprises a thermoplastic material, high temperature plastic or ceramic. The size and length of the vent tube 50 is adjustable, which can allow the induction cooktop 10 to be installed at a variety of heights. The length of the vent tube 50 can be fixed or adjusted to accommodate the different heights. The vent tube 50 can also be disposed within the cabinet 16 to allow for the intake air to be drawn from any suitable location. For example, installation requirements may dictate that the intake air supply come from the sides or back of the cabinet 16, or from an area external to the cabinet. The use of the vent tube 50, which can be at least partially flexible and/or include bends, allows the intake air to be drawn from any desired location.

Figure 5:
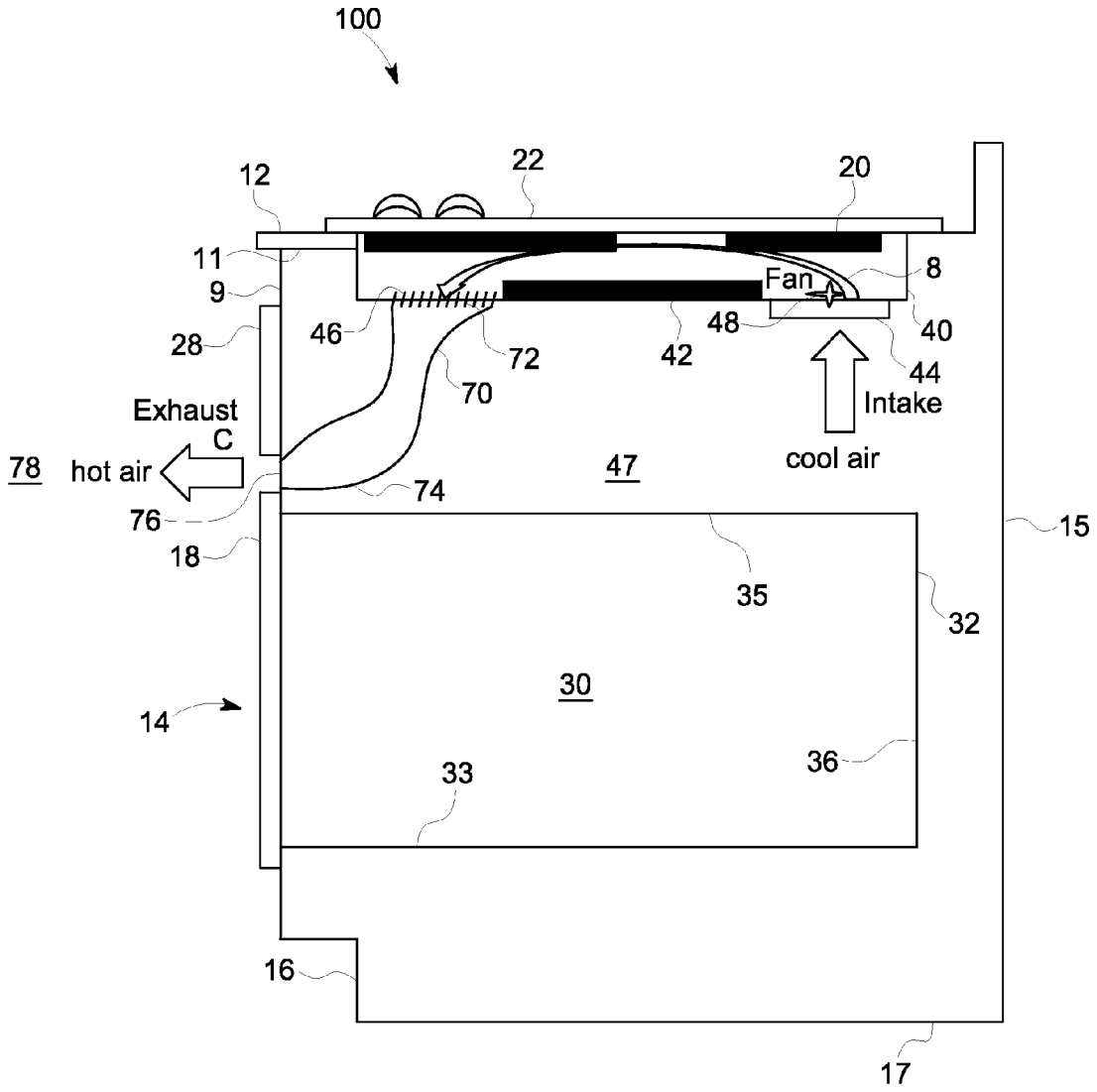
FIG. 5 is a side cross-sectional view of another embodiment of the appliance shown in FIG. 1.

FIG. 5 illustrates another embodiment of the appliance 100 shown in FIG. 1 incorporating aspects of the present disclosure. In this embodiment, a vent tube 70 is used to vent the higher temperature air being exhausted from housing 40 directly from the exhaust opening 46 into the environment or region 78 outside of the cabinet 16. In this manner, the higher temperature air being exhausted from the housing 40 is not delivered or circulated into the area 47 of the cabinet 16. Rather, it is expelled from to the environment 78 external to the cabinet 16.

In the embodiment of FIG. 5, a first end 72 of the vent tube 70 is coupled to the exhaust opening 46. A second end 74 of the vent tube 70 is coupled to an opening or vent 76 in the front wall 9. The vent 76 allows the higher temperature air being exhausted from the cabinet 40 to be vented in the direction generally indicated by the arrow C to the area 78 outside of the cabinet 16. The intake opening 44 draws cooler air from inside the cabinet 16 into the housing 40. Since the air inside the cabinet 16 is not the higher temperature air from the housing 40, the air delivered by the intake 44 into the housing 40 provides an improved cooling or heat dissipation effect within the housing 40 than is the case when the higher temperature air is recirculated through the housing 40. Although the example illustrated in FIG. 5 shows the higher temperature air being exhausted through vent 76 in the front wall 9 of the cabinet 16, in cases where it is not desirable to vent warmer air out to the area 78 in front of the appliance 100, in one embodiment, the vent tube 70 could be repositioned and coupled to an opening (not shown) in the back wall 15 of the cabinet 16. In this embodiment, the higher temperature air from the housing 40 could be vented to an area in back of the cabinet 16. In alternate embodiments, the vent 76 could also be in one or more of the side or bottom walls 13, 17 of the cabinet 16.

The vent tube 70 can generally be similar to the vent tube 50 of FIG. 4, and can comprise a flexible tube that is heat resistant. The size and length of the vent tube 70 is adjustable, which allows for installation at a variety of heights under the cooktop 10. The vent tube 70 can also be disposed within the cabinet 16 to allow for the exhaust air to be vented to any suitable location. For example, installation requirements may dictate that the exhaust air be vented out the top, sides or back of the cabinet 16, or to an area external to the cabinet that does not directly face the user. The aspects of the disclosed embodiments can accommodate any requirements in that regard.

The aspects of the disclosed embodiments provide for improving the cooling of the electronics in an induction cooktop system. Instead of venting the higher temperature air from the cooling of the electronic components in a manner that allows for the higher temperature air to be recirculated into the air cooling circulation pathway, the intake air and the exhaust air of the air circulation pathway are redirected and/or segregated. This allows the intake side of the air cooling circulation pathway to draw cooler air for cooling the electronic components, while the higher temperature air is vented away from the intake. The aspects of the disclosed embodiments allow installations at a variety of heights under the cooktop. The improved heat dissipation and disposal provide for, among other things, improved electronic component reliability and lifespan.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An induction cooktop appliance comprising:

a housing having an air intake opening at one end and an air exhaust at an opposite end, the air intake opening and the air exhaust opening defining an air cooling circulation path through an interior of the housing;

an induction cooktop disposed on top of the housing;

electronics for the induction cooktop disposed within the housing; and a vent tube having a first end and a second end, the vent tube being configured to segregate air entering the air intake opening of the housing from air exiting the air exhaust opening of the housing, the first end of the vent tube being coupled to a cool air supply and the second end of the vent tube being coupled to the air intake opening of the housing, wherein only air from the vent tube enters the air intake opening of the housing, wherein air exiting the air exhaust opening of the housing does not mix with air from the vent tube entering the air intake opening of the housing.

2. The induction cooktop appliance of claim 1, wherein the first end of the vent tube comprises an air intake and the second end comprises an air exhaust.

3. The induction cook top appliance of claim 1, further comprising a cabinet defined by a top, a bottom, a back and sidewalls, the induction cook top being disposed in an opening in the top of the cabinet.

4. The induction cook top appliance of claim 3, further comprising a built-in appliance disposed in the front wall of the cabinet below the induction cooktop, an area between the housing for the induction cooktop and the built-in appliance defining an interior cabinet area, an area below the built-in appliance defining a cool air region, wherein the intake opening receives cooling air from the cool air region.

5. The induction cook top appliance of claim 4, wherein the first end of the vent tube is disposed in the cool air region and the second end is coupled to the air intake opening of the housings.

6. The induction cook top appliance of claim 4, wherein the first end of the vent tube is coupled to the air exhaust opening of the housing and the second end is coupled to an exhaust air discharge vent.

7. The induction cook top appliance of claim 1, wherein a length of the vent tube is adjustable.

8. The induction cook top appliance of claim 1, wherein the vent tube comprises a flexible conduit.

9. An appliance comprising:

a cabinet defined by a front wall, a top wall, a back wall, a bottom wall and side walls;

an induction cooktop disposed in an opening in the top wall of the cabinet;

a housing for the induction cooktop, electronics for the induction cooktop disposed within the housing, the housing including an air intake opening at one end of the housing and an air exhaust opening at an opposite end of the housing, the air intake opening and the air exhaust opening defining an air cooling circulation path through an interior of the housing;

a built-in appliance disposed in an opening in the front wall of the cabinet and below the induction cooktop;

a first interior cabinet air area defined between the built-in appliance and the induction cooktop;

a second interior cabinet air area defined between the built-in appliance and the bottom wall of the cabinet;

a vent in the back wall of the cabinet proximate the second interior cabinet air area; and a vent tube disposed within the cabinet having one end coupled to the air intake opening in the housing and a second end disposed in the second interior cabinet air area proximate the vent in the back wall, wherein the coupling of the one end of the vent tube to the air intake opening fluidly segregates the air intake opening from the first interior cabinet air area.

10. The appliance of claim 9, wherein the air exhaust opening is communicatively coupled with the first interior cabinet air area.

11. The appliance of claim 10, wherein the second end of the vent tube is disposed a predetermined distance above the bottom floor of the cabinet.

12. The appliance of claim 10, wherein the vent defines an opening to an exterior of the cabinet and the second end of the vent tube is coupled to the vent.

13. The appliance of claim 9, wherein the air intake opening comprises an intake side and an exhaust side, a fan being coupled to the exhaust side of the air intake opening and configured to draw air from the vent tube and direct the air into the air cooling circulation path.

14. The appliance of claim 9, wherein the air circulation path is defined between the top wall of the cabinet and the electronics.

15. The induction cook top appliance of claim 3, comprising a vent in the back of the cabinet to air external to the cabinet, the first end of the vent tube coupled to the vent in the back of the cabinet.

16. The induction cook top appliance of claim 1, wherein the air intake opening comprises an intake side and an exhaust side, a fan being coupled to the exhaust side of the air intake opening and configured to draw air from the vent tube and direct the air into the air cooling circulation path.

17. The induction cook top appliance of claim 1, wherein the air cooling circulation path is between the induction cooktop and the electronics.

* * * * *